US011071421B2

(12) United States Patent
Kassab et al.

(10) Patent No.: US 11,071,421 B2
(45) Date of Patent: Jul. 27, 2021

(54) PORTABLE URINAL SYSTEMS, DEVICES, AND METHODS TO USE THE SAME

(71) Applicants: Ghassan S. Kassab, La Jolla, CA (US); Ali Dabiri, San Diego, CA (US)

(72) Inventors: Ghassan S. Kassab, La Jolla, CA (US); Ali Dabiri, San Diego, CA (US)

(73) Assignee: 3DT Holdings, LLC, San Diego, CA (US)

( * ) Notice: Subject to any disclaimer, the term of this patent is extended or adjusted under 35 U.S.C. 154(b) by 26 days.

(21) Appl. No.: 16/530,990

(22) Filed: Aug. 2, 2019

(65) Prior Publication Data

US 2020/0060483 A1 Feb. 27, 2020

Related U.S. Application Data

(60) Provisional application No. 62/723,325, filed on Aug. 27, 2018.

(51) Int. Cl.
*A47K 11/12* (2006.01)

(52) U.S. Cl.
CPC ..... *A47K 11/12* (2013.01)

(58) Field of Classification Search
CPC ..... A47K 11/12
USPC ..... 4/144.3
See application file for complete search history.

(56) References Cited

U.S. PATENT DOCUMENTS 940,077 A * 11/1909 Sherman ..... A61F 5/455 604/347
2,491,799 A * 12/1949 Clarke ..... A61F 5/451 604/347
3,572,318 A * 3/1971 Garland ..... A61B 10/007 600/574
4,050,103 A * 9/1977 Nakao ..... A61G 9/006 4/144.3
4,121,306 A * 10/1978 Bringman ..... A61G 9/006 4/144.3
4,901,375 A * 2/1990 Dahlgren ..... A61F 5/44 224/148.2
5,300,052 A * 4/1994 Kubo ..... A61F 5/453 4/144.1
5,894,608 A * 4/1999 Birbara ..... A47K 11/12 4/144.3
6,021,531 A * 2/2000 Kirko ..... A47K 11/12 4/144.1
6,668,388 B2 * 12/2003 Buttigieg ..... A61F 5/441 4/144.2
6,684,414 B1 * 2/2004 Rehrig ..... A47K 11/12 4/144.1
7,018,366 B2 * 3/2006 Easter ..... A61F 5/451 604/327
7,018,367 B2 * 3/2006 Nava ..... A61F 5/453 4/144.3

(Continued)

*Primary Examiner* — Lori L Baker
(74) *Attorney, Agent, or Firm* — Reichel Stohry Dean LLP; Mark C. Reichel; Natalie J. Dean

(57) ABSTRACT

A portable urine collection device comprising a receiving cup, a discharge tube, and a storage bottle. The device may also comprise snap coupling connectors, an air vent, a one-way valve and a protrusion in the receiving cup for male genitalia. The device may also be used with female genitalia without a protrusion. A support may also be used with the portable urine collection device. Methods of use are also provided.

20 Claims, 5 Drawing Sheets

(56) References Cited

U.S. PATENT DOCUMENTS 7,181,781 B1 * 2/2007 Trabold ..... A61F 5/455 4/144.1
7,325,256 B1 * 2/2008 Pecinka, Sr. ..... A61F 5/4556 4/144.1
7,762,596 B1 * 7/2010 Gaydos ..... A01K 23/005 294/1.5
8,181,284 B1 * 5/2012 Parker ..... B60R 15/04 4/458
8,650,669 B1 * 2/2014 Kolter ..... A47K 11/12 4/144.1
9,339,595 B2 * 5/2016 Ma ..... A61M 1/0011
2004/0143229 A1 * 7/2004 Easter ..... A61F 5/451 604/322
2005/0097662 A1 * 5/2005 Leimkuhler ..... A61F 5/4556 4/144.3
2006/0111648 A1 * 5/2006 Vermaak ..... A61F 5/455 600/574
2009/0056003 A1 * 3/2009 Ivie ..... A61F 5/4556 4/144.3
2012/0210503 A1 * 8/2012 Anzivino, Sr. ..... A61F 5/4556 4/144.3
2013/0317389 A1 * 11/2013 Ma ..... A61M 1/008 600/562
2014/0033414 A1 * 2/2014 Kolter ..... A47K 11/12 4/144.3
2014/0157499 A1 * 6/2014 Suzuki ..... A47K 11/00 4/144.3
2014/0182051 A1 * 7/2014 Tanimoto ..... A61G 9/006 4/144.3
2014/0325746 A1 * 11/2014 Block ..... A61F 5/455 4/144.3
2016/0113809 A1 * 4/2016 Kim ..... A61F 5/4408 604/353
2017/0325788 A1 * 11/2017 Ealovega ..... A61F 5/4553
2018/0036461 A1 * 2/2018 Shechter Ushpizin ..... A61M 1/068
2020/0115665 A1 * 4/2020 Bayley ..... C12M 21/08
2020/0237388 A1 * 7/2020 Eisenfrats ..... A61B 17/22
2020/0246179 A1 * 8/2020 Peyman ..... A61F 7/00
2020/0246502 A1 * 8/2020 Shandas ..... C08G 65/33324

* cited by examiner

PORTABLE URINAL SYSTEMS, DEVICES, AND METHODS TO USE THE SAME

PRIORITY

The present patent application is related to, and claims the priority benefit of, U.S. Provisional Patent Application Ser. No. 62/723,325, filed on Aug. 27, 2018, the contents of which are hereby incorporated by reference in their entirety into this disclosure.

BACKGROUND OF THE INVENTION

Frequent urination is the need to urinate more than you normally would. The urge can strike suddenly and can cause you to lose control of your bladder. It can feel uncomfortable, like your bladder is extremely full. Urologists, who are doctors that specialize in the urinary system, consider going more than 8 times in 24 hours to be frequent urination.

There are several instances that you need to visit bathroom. For example, a frequent need to wake up and go to the bathroom to urinate at night which is called nocturia. Nocturia is a common cause of sleep loss, especially among older adults.

Due to anatomical differences, men and women experience the urge to urinate for different reasons. Women generally experience it as a consequence of childbirth, menopause, and/or pelvic organ prolapse. In men, it can be directly attributed to benign prostatic hyperplasia (BPH), also known as enlarged prostate. The urge to urinate can also be a symptom of other medical conditions including urological infection, a tumor of the bladder or prostate, a condition called bladder prolapse, or disorders affecting sphincter control. It is also common in people with heart failure, liver failure, poorly controlled diabetes mellitus, or diabetes insipidus. Diabetes, pregnancy and diuretic medications are also associated with frequent urination.

Nocturia

Most people without nocturia can sleep for 6 to 8 hours without having to urinate. Some researchers believe that one event per night is within normal limits; two or more events per night may be associated with daytime tiredness. Patients with severe nocturia may get up five or six times during the night to urinate. Nocturia can affect the sleep cycle which can lead to sleep deprivation, fatigue, drowsiness, and mood changes. It can also disturb the partner's sleep due to visiting the bathroom more often.

One in three adults over the age of 30 makes at least two trips to the bathroom every night. It can happen at any age while the majority of those who are dealing with nocturia are usually over the age of 60. Two in three women over age 40 wake up at least once each night because of a full bladder and nearly half of them make two or more nighttime trips to the bathroom. There are several causes of nocturia in women.

Sometimes, it can be treated by behavior modification like:

- Restriction of Fluid Intake—Limiting the intake of fluids in the evening results in a decreased amount of urine produced at night.
- Afternoon Naps—This can help reduce fluid build-up by allowing liquid to be absorbed in the bloodstream. When awakening from a nap, the patient can use the bathroom and eliminate excess urine.
- Elevation of Legs—Like naps, elevating legs helps redistribute fluids so they can be reabsorbed into the blood stream.

- Compression Stockings—Creating an effect similar to elevating your legs, these elastic stockings exert pressure against the leg while decreasing pressure on the veins. This allows fluids to be redistributed and reabsorbed into the bloodstream.

Different medicinal options exist to alleviate and even treat nocturia. These may be used. alone or combined with some of the behavioral modifications listed above, which has been proven to be more effective. However, studies have confirmed that medication works only as long as taken. Once off medication, relapses are quite common. Additionally, all medications have some side effects.

Several solutions have been proposed to manage nocturnal enuresis such as:

- Mattress Covers—A variety of products exist to protect the bed including vinyl, waterproof and absorbent mattress covers or sheet protectors, which can make cleanup easier if bedwetting occurs.
- Absorbent Briefs—These products are a form of modified underwear designed to absorb liquid, therefore preventing leakage. Both reusable and disposable products are available.
- Skincare Products—Many products exist to protect the skin from irritation and soreness that occur when a person experiences nocturnal enuresis. A range of soaps, lotions, and cleansing cloths exist for various skin types.

These methods are either not effective, or have several disadvantages like smell, leaks and lack of sufficient storage capacity.

Overactive Bladder

Overactive bladder occurs because the muscles of the bladder start to contract involuntarily even when the volume of urine in your bladder is low. This involuntary contraction creates the urgent need to urinate. The urge may be difficult to stop, and overactive bladder may lead to the involuntary loss of urine (urge incontinence). If you have an overactive bladder, you may feel embarrassed, isolate yourself, or limit your work and social life. According to the American Urological Association, an estimated 33 million Americans have an overactive bladder. This affects about 40 percent of all women in the United States. Excessive caffeine, nicotine, artificial sweeteners, and alcohol may also irritate the bladder walls and can worsen frequent urination symptoms.

Management of overactive bladder often begins with behavioral strategies, such as fluid schedules, timed voiding and bladder-holding techniques using pelvic floor muscles. If these initial efforts don't help enough with overactive bladder symptoms, medications are usually advised.

In view of the foregoing, there is a need for devices, systems, and methods to eliminate the need to go to bathroom several times during the night by urination while in the bed during sleep which in turn improves the sleep cycle. This could eliminate the negative impacts of conventional treatments and management, and said devices, systems, and methods would be well received in the marketplace.

BRIEF SUMMARY

The present disclosure describes a portable urine collection device operable while the patient is asleep or otherwise unable to rise and use a restroom.

In one embodiment of a portable urine collection device, the device comprises a receiving cup (pouch); a discharge tube having a proximal end and a distal end; a storage bottle; and the receiving cup is connected to the proximal end and the storage bottle is connected to the distal end. The device is preferably fluid-tight. Specifically, the receiving cup is configured to attach to the patient.

In other embodiments of a portable urine collection device, the device may additionally comprise one or more of the following components.

In another embodiment of a portable urine collection device, the device may further comprise at least one snap coupling connectors (e.g., barbed fitting) wherein the at least one snap coupling connectors comprise a fluid-tight connection and is disposed between the discharge tube and the storage bottle and between the discharge tube and the receiving cup.

In another embodiment, the receiving cup is comprised of silicone or a similar compliant material.

In another embodiment, the device comprises a first coupling and a second coupling wherein the first coupling is disposed between the discharge tube and the storage bottle and the second coupling is disposed between the discharge tube and the receiving cup and wherein both couplings comprise a fluid tight connection.

In another embodiment of a portable urine collection device, the receiving cup, discharge tube and storage bottle are a single piece. In another embodiment of a portable urine collection device, the receiving cup, discharge tube, storage bottle, and support are a single piece. In a further embodiment, the discharge tube and the storage bottle are a single piece.

In another embodiment of a portable urine collection device, the device may comprise a passage formed by the receiving cup, discharge tube, and the storage bottle, wherein the passage allows for the flow of urine from the receiving cup through the discharge tube to the storage bottle.

In another embodiment of a portable urine collection device, the device may comprise a one-way valve in the passage. The one-way valve may also be located in the discharge tube near the receiving cup or near the distal end of the discharge tube and near the storage bottle.

In another embodiment of a portable urine collection device, the device further comprises a clip attached to the discharge tube, the clip configured to attach to an article of clothing.

In an another embodiment, the discharge tube is an anti-kinking tube. The discharge tube can also or alternatively comprise an accordion type tubing.

In another embodiment of a portable urine collection device for men, the receiving cup is shaped to have a palm and a protruding finger. The palm covers the testicles and scrotum of a patient and the finger encloses the penis of the patient. In another embodiment, the receiving cup for men has only the finger portion, being generally cylindrical, and encloses at least a part of the shaft of the patient.

In another embodiment of a portable urine collection device, the receiving cup is designed for use with female genitalia, wherein the receiving cup is more shallow and has a natural profile without a male protrusion. The receiving cup is also shaped to cover only the urethra opening.

In another embodiment, the receiving cup is attached to the patient by an adhesive material. The adhesive may be a is a reversible, thermo-responsive poly(N-isopropylacrylamide) (PNIPAM) material.

In another embodiment of a urine collection device, the device includes a support, which may be similar to an article of clothing such as underwear. The support is constructed such that the penis or receiving cup may penetrate the support and the support may thereby hold the genitals in place, restricting movement. In another embodiment, the support surrounds the hips and/or waist of the patient.

In another embodiment, the storage bottle comprises an air vent. In another embodiment the storage bottle may be flexible and/or slim and configured to be attached to a patient, such as being strapped around a patient's leg or thigh.

In an exemplary method of use for a portable device for urine collection, the steps for use comprise the steps of: attaching the receiving cup to the genitals; connecting the discharge tube to the receiving cup; connecting the discharge tube to the storage bottle.

In an alternate exemplary method of use, the steps for use may further comprise one of more of the following steps: placing the storage bottle at bed side; wearing a support over the receiving cup; connecting a clip to the discharge tube and the support; laying the patient in a reclined position; urinating into the receiving cup; passing the urine from the receiving cup to the storage bottle via the discharge tube.

BRIEF DESCRIPTION OF THE DRAWINGS

The disclosed embodiments and other features, advantages, and disclosures contained herein, and the matter of attaining them, will become apparent and the present disclosure will be better understood by reference to the following description of various exemplary embodiments of the present disclosure taken in conjunction with the accompanying drawings, wherein.

Figure 1:
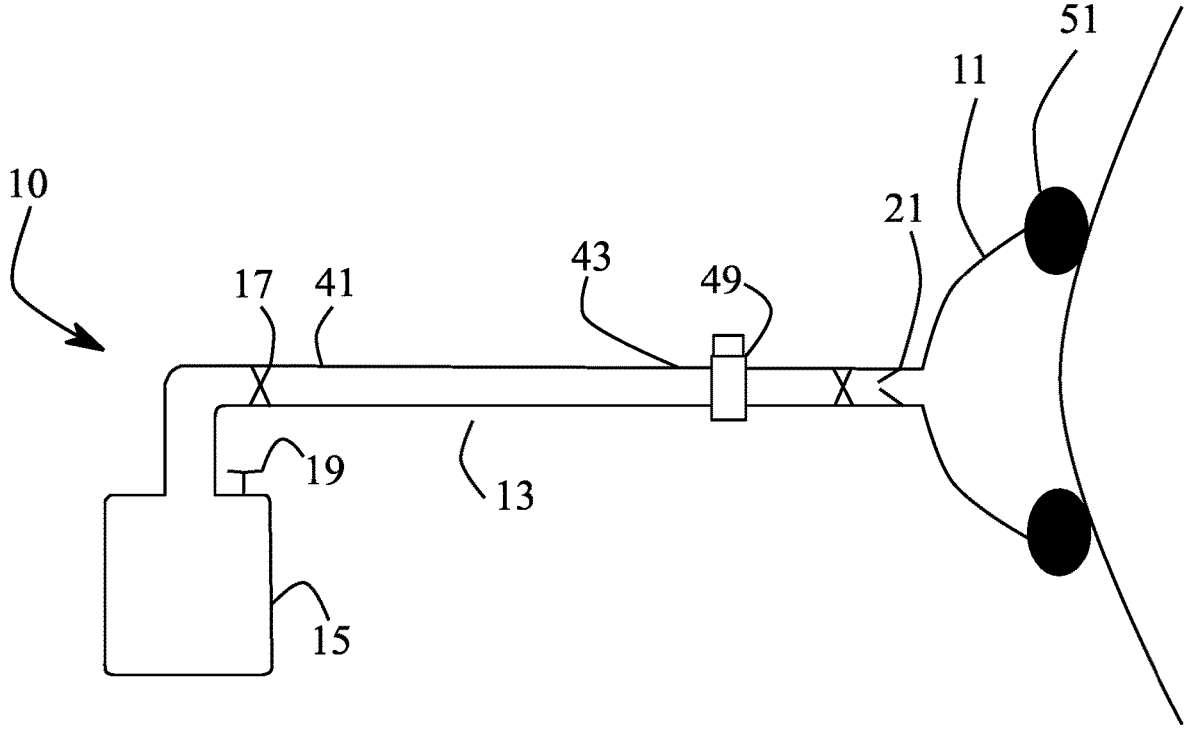
FIG. 1 shows a schematic view of one embodiment of a portable urine collection device according to the present disclosure.

As such, an overview of the features, functions and/or configurations of the components depicted in the various figures will now be presented. It should be appreciated that not all of the features of the components of the figures are necessarily described and some of these non-discussed features (as well as discussed features) are inherent from the figures themselves. Other non-discussed features may be inherent in component geometry and/or configuration. Furthermore, wherever feasible and convenient, like reference numerals are used in the figures and the description to refer to the same or like parts or steps. The figures are in a simplified form and not to precise scale.

DETAILED DESCRIPTION

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

An objective of the present invention is to provide a non-invasive means of treating urinary dysfunction. The goals of the embodiments herein are to isolate urethral and vaginal openings to prevent any urine leak to the vagina during urination, be non-occlusive of the vagina, provide means of collecting urine with minimum amount of skin contacted by urine, and to be comfortable to the patient. Furthermore, the embodiments are universal such that one size and configuration fits most women and need not be custom made. The embodiments are also useful when the patient is walking, standing, seating, reclining or sleeping.

Although the disclosed devices, systems and methods of the present disclosure are presented in the context of treating a patient for sleep disorders such as nocturia, enuresis and overactive bladder, the context presented is not intended to be limiting. For example, it is envisioned that the subject of the present disclosure may be used to treat any patient who has difficulty moving to a toilet and urinate. It is further envisioned that the disclosed devices, systems and methods may be used to assist any user in any situation where urinating in a toilet is inconvenient for any reason. It is further envisioned that the disclosed devices, systems and methods may be used to assist any user in any situation where a toilet is not accessible for any reason such as driving in a car. In this scenario the storage bag is attached to the leg or other body part.

The words proximal and distal are used in the disclosure to refer to components of the device 10 located closer to the patient and farther from the patient, respectively.

A primary objective of the devices, systems and methods of the present disclosure is to eliminate the need to awaken and use the bathroom while sleeping. The devices and methods herein help prevent interruption of the sleep cycle and also eliminate soiling of bed sheets from sleep disorders such as nocturia or enuresis. This device also prevents older patients from accidentally falling due to loss of control while going to toilet. The device additionally addresses many of the issues of conventional treatments of sleep disorders, such as medicinal treatments which must be used continually to be effective. As a result of using the embodiments herein, the patient's quality and duration of sleep is improved. As an added benefit, the device also aids in keeping the patient's sleeping area sanitary, thereby improving the cleanliness and comfort of the patient's sleeping conditions.

Another of objective of the devices, systems and methods of the present disclosure is to avoid frequent visits to toilet at other times while the patient is not in bed. In this scenario, the mobile version of the device should be used where the storage bag is strapped around the leg or otherwise attached to the body.

A first embodiment of an exemplary device 10 of the present disclosure for women comprises the components such as according to the configuration shown in FIG. 1. The figure shows the schematic of the device 10 which comprises at least of three components: 1) receiving cup 11 connected to the genital part of the body, 2) discharge tube 13, and 3) storage bottle 15 for storing urine.

The receiving cup (pouch) 11 is configured such that it may attach securely to the genitals of the user in a fluid-tight manner. Where the embodiment is configured for the female anatomy, the receiving cup is sized to encompass the urethra only and avoids encapsulating the vagina. A cup 11 for use on female genitalia does not comprise a protrusion for housing male genitalia and is shallow having a low natural profile. The receiving cup 11 is operably connected to a proximal end 43 of a discharge tube 13, and the two are in fluid communication with each other. The discharge tube 13 connects the receiving cup 11 to the storage bottle 15. The storage bottle 15 is connected to the distal end 41 of the discharge tube 13. The storage bottle also comprises an air vent 19.

In the embodiment of FIG. 1, the receiving cup 11 is sized and configured such that it encompasses only the urethra opening. This ensures the urethra opening is isolated from the vagina opening and it eliminate the possibility that bacterial strains in urine may enter the vagina. The receiving cup is attached to the urethra area by an adhesive 51 material. The adhesive material should be chosen not to produce allergic or other adverse effects to the patient. One option is to use thermally reversible glue. The glue may be reversible, thermo-responsive poly(N-isopropylacrylamide) (PNIPAM). It is in liquid state at room temperature and becomes solid at body temperature. Another option for the adhesive material could be Hollihesive which is manufactured by Hollister Company. The material of the receiving cup could be silicone or any other bio-material with similar properties.

The receiving cup 11, discharge tube 13, and storage bottle 15 of the device 10 may be three inseparable sections of a single component or, as in FIG. 1, may also be three separable components. The receiving cup may a single component that fits over the genitals forming a leak-free seal. If separable components, they may be connected in any suitable fashion, such as with couplings, and the connections are preferably also fluid-tight. For example, the discharge tube 13 may be connected to the receiving cup 11 and the storage bottle 15 by snap coupling connectors 17 which are leak proof and can easily be uncoupled. It is also preferable that the entire device 10 is fluid tight such that urine enters the receiving cup 11 and passes through the discharge tube 13 into the storage bottle 15.

A clip 49 is installed near the proximal end 43 of the discharge tube 13 to be connected to the clothing of the proximal end 43 thus isolating any body movement from the rest of the device 10. This aids in retaining the connection between the receiving cup 11 and the proximal end 43 of the discharge tube 13.

The discharge tube 13 may be of a flexibility and firmness that such that the patient's movement will not break or crush the discharge tube 13. It could also be disposable due to its low cost. The length of the tube should be such that, in addition to reaching the storage bottle 15 located at the bed side, is has enough slack for the patient's movement. This may be achieved by utilizing accordion type tubing. Accordion type tubing may be ridged and able to collapse longitudinally to become shorter while still allowing fluid passage. The discharge tube may consist entirety or mostly of the accordion type tubing. The discharge tube should also be anti-kinking to assure smooth flow during urination. Anti-kink tubing may be thicker, or reinforced such as to be stiffer as opposed to tubing that may kink due to patient movement.

In a preferred embodiment, the receiving cup 11, the storage bottle 15 and discharge tube 13 may be reusable, or alternatively may be disposable and for one time use, or alternatively, the receiving cup may be disposable and the other two components resusable. All the non-disposable components have to be washed daily.

The storage bottle 15 may have a capacity as large as one liter, and can be a hard bottle, such as a glass bottle, or alternatively may be a flexible container and made from a plastic material. During use, the storage bottle 15 is preferably located near the bed side when the patient is in the bed and is preferably strapped around the leg or otherwise attached to the body at other times. The bottle is equipped with a one-way valve 21 to vent the air as urine enters the bottle. This valve is leak proof to ensure any undesirable odors remain in the bottle.

Also shown in FIG. 1 is an optional one-way valve 21 operably connected to the discharge tube 13 near the proximal end 43. The one-way valve 21 could also be connected to the receiving cup 11. The one-way valve 21 prevents backflow of urine while the device is in use.

Figure 2A:
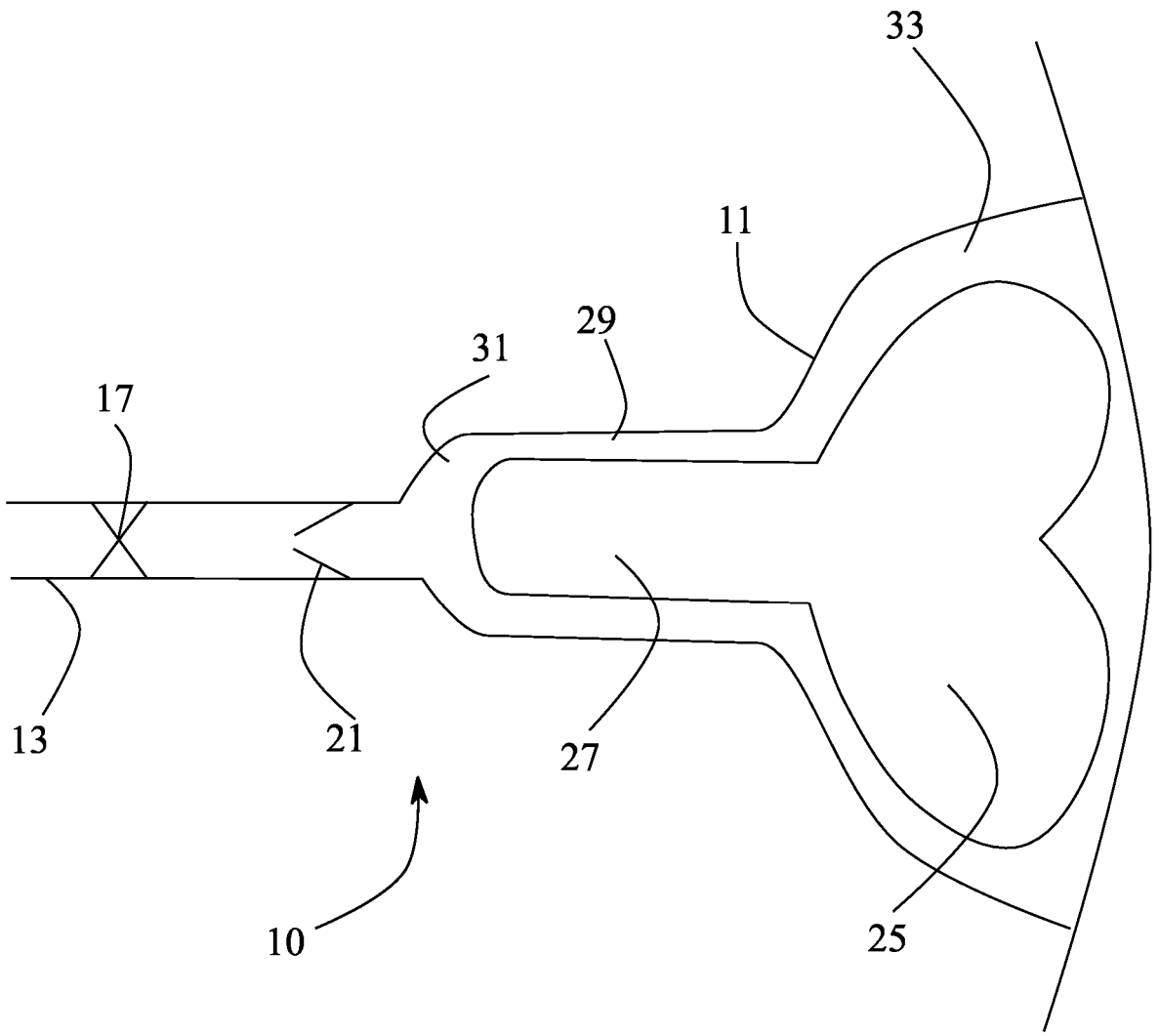
FIG. 2A shows a schematic view of another embodiment of a portable urine collection device attached to a patient according to the present disclosure.

Pictured in FIG. 2A is an embodiment of the present invention intended for use on patients having male genitalia. Like the embodiment illustrated in FIG. 1, the device 10 of FIG. 2A comprises a receiving cup 11, discharge tube 13 and storage bottle 15. One-way valves may also be included. The device 10 may also comprise leak-proof connectors such as snap couplings connectors or barbed fitted connectors 17. Embodiments described below intended for use on male genitalia share many of the features of the embodiment described above.

As mentioned, the receiving cup of a device intended for male anatomy may be sized differently than a device sized for female anatomy. FIG. 2A depicts the receiving cup 11 of an alternate embodiment of the present invention. In this embodiment the receiving cup 11 is made of a compliant material like silicone. The receiving cup 11 is further formed to cover the genitals including the penis 27 and testicles/scrotum 25. The shape of the receiving cup 11 resembles a glove having a proximal area, a "palm," configured to fit the testicles/scrotum and a smaller distal area, a centrally positioned "finger," 29 for configured to fit the penis. During use, the patient's penis 27 rests inside the finger 29 of the receiving cup 11 and the testicles will rest inside the palm 33 of the glove. The distal end 31 of the finger 29 opens to a short tube which couples to the discharge tube 13 by way of a snap coupling connector 17. There is a one-way valve 21 at the outlet of receiving cup 11 that connects to the discharge tube 13. The receiving cup 11 in this configuration is leak proof all around its edge due to the use of suitable adhesive material. PNIPAM is an exemplary adhesive that may be used. Adhesive may be used on the proximal edge of the cup where it contacts the patient to securely fasten the cup.

Figure 2B:
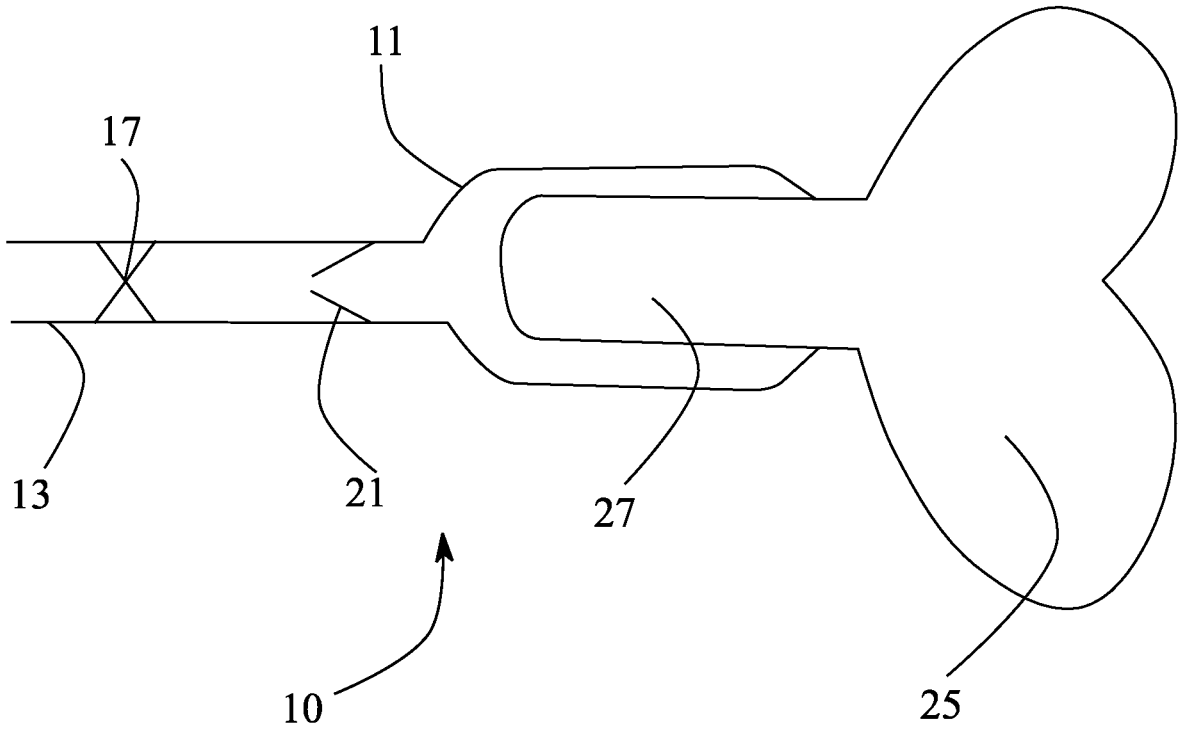
FIG. 2B shows a schematic view of another embodiment of a portable urine collection device attached to a patient according to the present disclosure.

FIG. 2B depicts another embodiment of a receiving cup 11 intended for use with male genitalia. In this embodiment, the receiving cup 11 is made of a compliant material like silicone and is connected to a discharge tube 13. The receiving cup 11 is comprised of a material that is leak proof and does not create discomfort to the patient during use. The receiving cup 11 may take a generally cylindrical shape and resemble a condom which the individual can wear. In an embodiment, the cup may extend partially along the penis, such as midway, or further or less, ending along the shaft. The cylinder may comprise openings at both ends, the openings being larger at the proximal end and smaller at the distal to accommodate the penis 27 and the discharge tube 13, respectively. The receiving cup of this embodiment cup will fit over the penis 27 without covering the testicles.

Figure 2C:
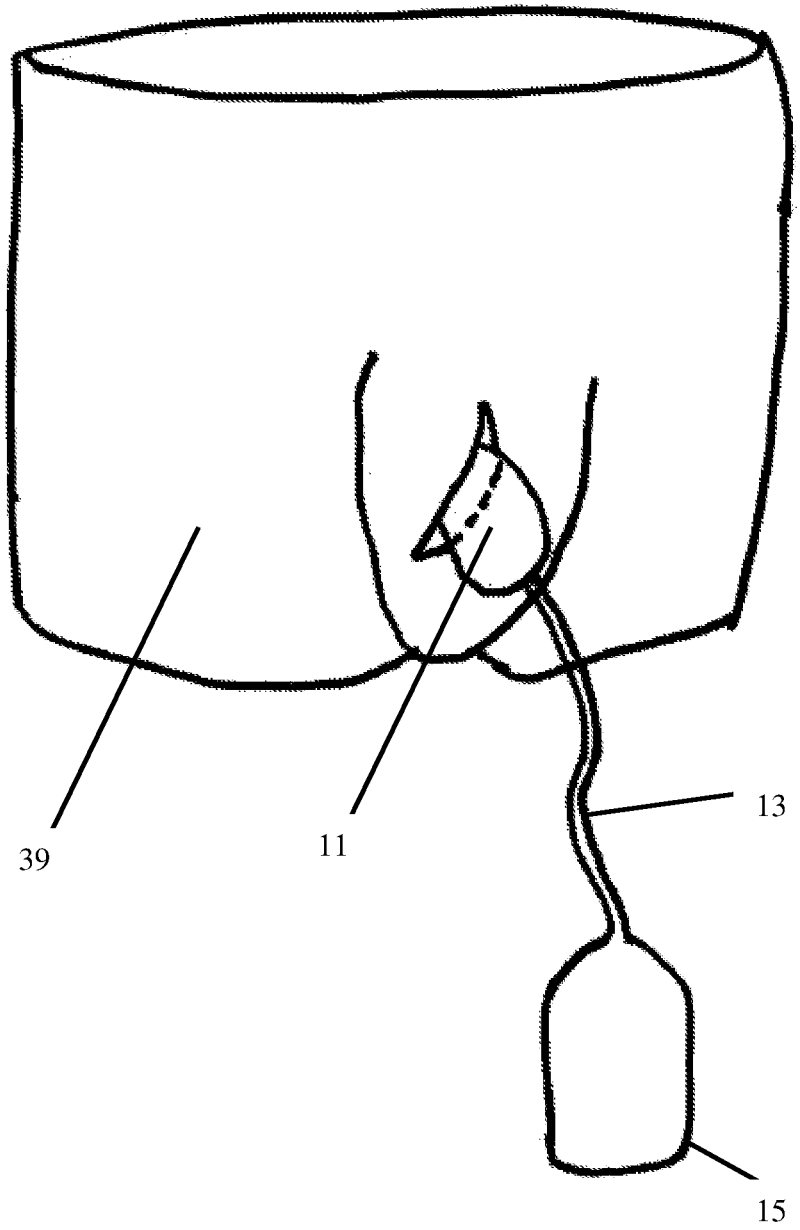
FIG. 2C shows an embodiment for an attachment device for attaching the portable urine collection device to the patient according to the present disclosure.

FIG. 2C depicts an alternate embodiment of the device 10. In this embodiment, the receiving cup 11 is supported against the genitals via a support 39 similar to an article of underwear-like clothing. Any of the receiving cups described above can be used with the support 39. The support 39 preferably surrounds the hips and/or waist of the user. At least a portion of the device, such as the receiving cup or discharge tube, may protrude from the underwear/support. The protruding portion of the device will extend through an opening in the support. The support 39 is configured to hold the genitals in place and constrain genital movement. In another embodiment the receiving cup 11 is integral with the support 39 to comprise a single piece.

One exemplary method of using the device 10 while sleeping includes the steps of (where the device has three separate components):

The patient places the storage bottle 15 at the bed side and then connects the discharge tube 13 to the storage bottle 15. The patient then wears the receiving cup 11 after going to bed before lying down on the bed. The individual then connects the other end of the discharge tube 13 to the receiving cup 11. Finally, the individual connects the clip 49 installed near the proximal end of the discharge tube 13 to the clothing such as underwear or pajamas to isolate any body movement from the rest of the device 10.

A similar method may be used with other embodiments of the device. Other exemplary methods may further comprise steps such as adhering the receiving cup to the patient, wearing a support garment over the receiving cup, urinating into the receiving cup, collecting excreted urine in the storage bottle, detaching the storage bottle to empty the bottle.

The advantage of this device is that the individual can urinate anytime without arousing from sleep. The device is very low cost and simple to assemble and disassemble. It may take the individual several days to get used not waking up to urinate.

Figure 3:
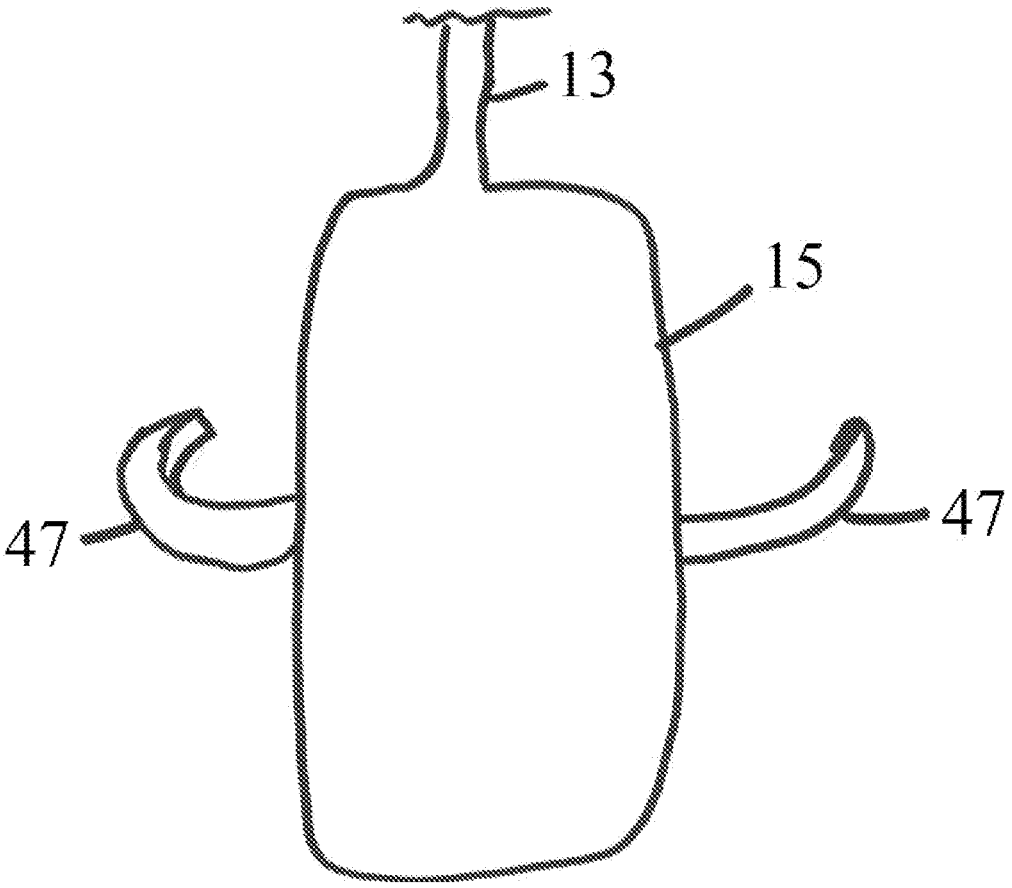
FIG. 3 shows a mobile embodiment of a storage bottle for a urine collection device.

This device/method can have a mobile embodiment where individuals can wear the device 10. This is particularly applicable for those who have to urine frequently as often as half an hour for some individuals. The storage bottle 15 form can be long and slim and attached around the leg with a strap 47. One embodiment of the storage bottle is shown in FIG. 3. The rest of the apparatus will be the same as the stationary version. In this embodiment the discharge tube 13 could be attached to the individual's thigh with an adhesive tape.

While various embodiments of devices and systems for treating frequent urination and methods for using the same have been described in considerable detail herein, the embodiments are merely offered as non-limiting examples of the disclosure described herein. It will therefore be understood that various changes and modifications may be made, and equivalents may be substituted for elements thereof, without departing from the scope of the present disclosure. The present disclosure is not intended to be exhaustive or limiting with respect to the content thereof.

Further, in describing representative embodiments, the present disclosure may have presented a method and/or a process as a particular sequence of steps. However, to the extent that the method or process does not rely on the particular order of steps set forth therein, the method or process should not be limited to the particular sequence of steps described, as other sequences of steps may be possible. Therefore, the particular order of the steps disclosed herein should not be construed as limitations of the present disclosure. In addition, disclosure directed to a method and/or process should not be limited to the performance of their steps in the order written. Such sequences may be varied and still remain within the scope of the present disclosure.

What is claimed is:

1. A device for portable urine collection comprising:

a receiving cup;

a discharge tube having a proximal end and a distal end;

a one-way valve located in the discharge tube;

a storage bottle; and wherein the receiving cup is connected to the proximal end of the discharge tube and the storage bottle is connected to the distal end of the discharge tube.

2. The device of claim 1, wherein the receiving cup is comprised of silicone or a similar material.

3. The device of claim 1, wherein the one-way valve is located near the receiving cup.

4. The device of claim 1, wherein the the one-way valve is located near the storage bottle.

5. The device of claim 1, wherein the discharge tube is an anti-kinking tube.

6. The device of claim 1, wherein the discharge tube comprises an accordion tubing.

7. The device of claim 1 further comprising a first coupling and a second coupling wherein the first coupling is disposed between the discharge tube and the storage bottle and the second coupling is disposed between the discharge tube and the receiving cup and wherein both couplings comprise a fluid tight connection.

8. The device of claim 1, further comprising a clip attached to the discharge tube, the clip configured to attach to an article of clothing.

9. The device of claim 1, wherein at least two of the receiving cup, the discharge tube, and the storage bottle are a single piece.

10. The device of claim 1, wherein the receiving cup, discharge tube and storage bottle are separate components.

11. The device of claim 1, further comprising a support, wherein the support holds the receiving cup against the patient.

12. The device of claim 11, wherein the support, receiving cup, discharge tube, and storage bottle are a single piece.

13. The device of claim 1, wherein the storage bottle comprises an air vent.

14. The device of claim 1, wherein the storage bottle is flexible and configured to be attached to a patient.

15. A device for portable urine collection comprising:

a receiving cup sized to cover only a female urethra opening, and not the vaginal opening;

a discharge tube having a proximal end and a distal end; and a storage bottle;

wherein the receiving cup is connected to the proximal end of the discharge tube and the storage bottle is connected to the distal end of the discharge tube.

16. The device of claim 15, wherein the receiving cup is attached to a patient by an adhesive material.

17. The device of claim 15, wherein the receiving cup is attached to the patient by an adhesive which is a reversible, thermo-responsive poly(N-isopropylacrylamide) (PNIPAM) material.

18. A method of use for a device for urine collection, comprising the steps of:

attaching the receiving cup to the genitals;

connecting the discharge tube to the receiving cup;

connecting the discharge tube to the storage bottle; and passing urine to flow through a one-way valve located in the discharge tube.

19. The method of claim 18, further comprising the steps of:

wearing a support over the receiving cup; and connecting a clip to the discharge tube and the support.

20. The method of claim 19, further comprising the steps of:

laying the patient in a reclined position;

urinating into the receiving cup; and passing the urine from the receiving cup to the storage bottle via the discharge tube.

* * * * *